US007757761B2

(12) United States Patent
Augustine

(10) Patent No.: US 7,757,761 B2
(45) Date of Patent: Jul. 20, 2010

(54) APPARATUS FOR REDUCING WATER PRODUCTION IN GAS WELLS

(75) Inventor: Jody R. Augustine, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 129 days.

(21) Appl. No.: 11/969,122

(22) Filed: Jan. 3, 2008

(65) Prior Publication Data

US 2009/0173496 A1 Jul. 9, 2009

(51) Int. Cl.
*E21B 43/00* (2006.01)

(52) U.S. Cl. ..... 166/276; 166/372

(58) Field of Classification Search ..... 166/276, 166/284, 228, 372
See application file for complete search history.

(56) References Cited

U.S. PATENT DOCUMENTS

| | | | | |
|---|---|---|---|---|
| 4,231,767 | A | 11/1980 | Acker | |
| 4,241,787 | A | 12/1980 | Price | |
| 5,435,393 | A | 7/1995 | Brekke et al. | |
| 6,187,079 | B1 | 2/2001 | Bridger | |
| 6,691,781 | B2 | 2/2004 | Grant et al. | |
| 6,723,158 | B2 | 4/2004 | Brown et al. | |
| 6,736,880 | B2 | 5/2004 | Ford et al. | |
| 6,932,160 | B2 | 8/2005 | Murray et al. | |
| 7,270,178 | B2 | 9/2007 | Selph | |
| 7,377,313 | B2 | 5/2008 | Brown et al. | |
| 7,413,022 | B2 | 8/2008 | Broome, et al. | |
| 7,503,389 | B2 * | 3/2009 | Delaloye et al. | 166/304 |
| 7,543,633 | B2 | 6/2009 | Brown et al. | |
| 2003/0021922 | A1 * | 1/2003 | Bode | 428/34.4 |
| 2004/0031608 | A1 | 2/2004 | Hall et al. | |
| 2006/0011345 | A1 * | 1/2006 | Delaloye et al. | 166/304 |
| 2006/0272814 | A1 | 12/2006 | Broome et al. | |

OTHER PUBLICATIONS

Augustine, Jody R., "An Investigation of the Economic Benefit of Inflow Control Devices on Horizontal Well Completions Using a Reservoir-Wellbore Coupled Model", SPE 78293, Oct. 2002, 1-10.
Asheim, H.A., "Natural Downhole Separation and Its Impact on Production Performance", SPE 57467, Oct. 1998, 315-320.
Bohorquez, R., et al., "Laboratory Testing of Downhole Gas Separators", SPE 109532, Nov. 2007, 1-15.
Guo, Boyun, et al., "Prediction of Influx Rate and Volume For Planning UBD Horizontal Wells to Reduce Fromation Damage", SPE 111346, Feb. 2008, 1-6.
Zibel AS, Ziebel's Preadjustable Inflow Control Device Technology (ICD), www.ziebel.biz, 3 pages, date unknown.

* cited by examiner

*Primary Examiner*—William P Neuder
(74) *Attorney, Agent, or Firm*—Steve Rosenblatt

(57) ABSTRACT

Production of liquids into a production string is regulated at inlets to the production string. An annular space is defined between a base pipe and a surrounding screen. The base pipe has inlets near one end of the screen and an overlaying shroud that spans over the screen and the inlet to the base pipe so as to define a restricted annular path to the base pipe opening and within the screen. A porous material is placed in the annular space and extends over the base pipe opening. If gas with liquid is produced, the gas having a lower density and viscosity preferentially gets through the porous media while the denser and more viscous water or other liquid is kept out due to greater resistance to flow offered by the porous media.

19 Claims, 1 Drawing Sheet

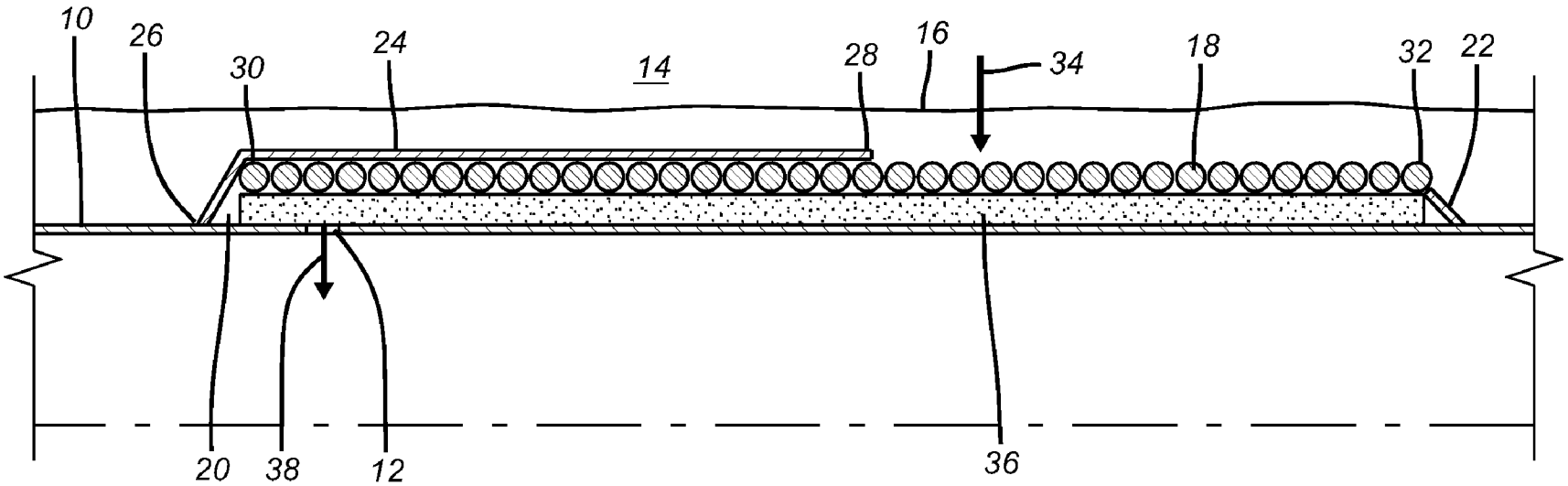
22
32
18
34
16
28
14
24
30
26
10
36
12
38
20

APPARATUS FOR REDUCING WATER PRODUCTION IN GAS WELLS

FIELD OF THE INVENTION

The field of the invention is control devices that preferentially allow gas to be produced while minimizing or excluding liquids from being produced.

BACKGROUND OF THE INVENTION

During the course of the life of a gas well, there are occasions when the formation starts producing significant amounts of liquid, most commonly water. The production of liquids can reduce the volume of gas produced. Depending on the formation pressure, the presence of liquid may result in an inability to push the produced fluids to the surface. At times the formation pressure can be low enough where only the less dense gas can be pushed to the surface with formation pressure. However, if the more dense liquid is present in sufficient quantities, then the formation pressure can be insufficient causing a reduction in gas production or the need to use artificial techniques to bring the production to the surface.

One solution that has been used is to use a downhole separator in conjunction with a submersible pump to actually produce the gas and liquids and separate them downhole so that the liquids can then be pumped to the surface for removal. This technique is illustrated in U.S. Pat. Nos. 6,736,880; 4,231,767 and 6,691,781. These solutions are complicated to execute because space is needed for auxiliary equipment as well as power being needed to drive the submersible pump. The present invention seeks an alternative to these traditional solutions by creating a device that preferentially lets the gas get produced while keeping the denser and more viscous water and other liquids from entering the production string. This is to be distinguished from techniques that provide varying resistance to production flow such as in a long horizontal run so as to avoid short circuiting into the production string at locations closer to the surface than more remote locations. One example of such a system is in US Application 2006/0272814 A1.

The present invention uses the difference in physical properties between gases and liquids to preferentially allow the gas to pass while reducing the liquid component of the incoming flow. In conjunction with an overlaying screen as an option, an annular space is provided between the screen and a base pipe where a flow resistance member is installed. The flow resistance member provides virtually little resistance to gas flow as compared to liquids and as a result reduces the amount of liquid passing through the annular area that reaches an opening in the base pipe. These and other advantages of the present invention will be more apparent to those skilled in the art from a review of the description of the preferred embodiment and the associated drawing while recognizing that the full scope of the invention is to be found in the claims.

SUMMARY OF THE INVENTION

Production of liquids into a production string is regulated at inlets to the production string. An annular space is defined between a base pipe and a surrounding screen. The base pipe has inlets near one end of the screen and an overlaying shroud that spans over the screen and the inlet to the base pipe so as to define a restricted annular path to the base pipe opening and within the screen. A porous material is placed in the annular space and extends over the base pipe opening. If gas with liquid is produced, the gas having a lower density and viscosity preferentially gets through the porous media while the denser and more viscous water or other liquid is kept out due to the greater resistance to flow offered by the porous media.

BRIEF DESCRIPTION OF THE DRAWING

FIG. 1 is a section view of one of potentially many inlets to a production string, shown in section to illustrate the operation of the invention.

DETAILED DESCRIPTION OF THE PREFERRED EMBODIMENT

FIG. 1 shows a base pipe or production string 10 with an assembly around an opening 12. There may be a plurality of displaced openings 12 each with an assembly about them as shown in FIG. 1. The wellbore 16 penetrates a formation 14 that is producing gas. After a while it is possible for the formation 14 to start producing liquids, most likely water. The illustrated assembly about the opening 12 is designed to preferentially admit gases while holding back or slowing down the advance of liquids toward the openings 12.

Screen 18, if used, is preferably a wire wrap design leaving an annular space 20 between the string 10 and itself. Space 20 is closed at one end by a cap 22 and at the opposite end by a preferably solid shroud 24 that overlays the openings 12 and serves also as an end ring similar to 22. The shroud creates a closed portion of the annular passage 20 that at one end starts at 26 and ends at 28. The screen 18 has a first end 30 that goes under the shroud 24 and a second end 32 that is adjacent the cap 22.

Incoming flow, represented by arrow 34, gets through the screen 18 and turns toward openings 12 in annular space 20. The annular space has a porous material 36 that preferably extends between caps 22 and 26 or some shorter distance such as just under the shroud 24. The porous material can be conjoined spheres or other shapes, porous sintered stainless balls, resin coated gravel pack sand, a woven mesh material, gravel pack sand or equivalent structures that cause flow turbulence as the flow 34 progresses toward openings 12 and goes through them into the string 10, as represented by arrow 38. The gasses pass through the material 36 with far less resistance due to low density and low viscosity while the liquids being more dense and viscous than the gases produced are more likely to be held back once in the material 36. Since in most applications there are many installations such as shown in FIG. 1 along the string 10 that service a producing formation 14 the buildup of liquids at one location of openings 12 will allow more gas from formation 14 to get to other openings 12 where no water or other liquid is being produced. Thus, without moving parts or power input, the preferred gas flow can continue while the flow of liquid is resisted. In the preferred embodiment, this occurs because of the differences in the physical properties of gasses and liquids giving gases the edge of passing through to the openings 12.

While the annular flow path is shown on the exterior of the string 10 it can also be located within the string and in an uphole or downhole orientation or combinations of the two. Various known screen alternatives can be used for screen 18 apart from a wire wrap design that is illustrated. Some examples would be prepacked screens or weave or twill screens. The screen 18 can be gravel packed in a known manner. Optionally, the screen 18 can be left out altogether.

The above description is illustrative of the preferred embodiment and various alternatives and is not intended to embody the broadest scope of the invention, which is determined from the claims appended below, and properly given their full scope literally and equivalently.

I claim:

1. A device for minimizing liquid flow into at least one inlet to a production sting in a gas well extending from a producing zone to a surface where the producing zone gas pressure is sufficient to deliver gas to the surface, comprising:

at least one flow path on the string extending from the inlet;

at least one material in said path through which all gas or liquid flows in the same direction to reach said inlet and then the surface using the gas pressure in the producing zone, said material offers greater resistance to flow driven just by gas pressure in the producing zone toward said inlet to liquids than gasses by creating more turbulence to liquid flow than gas flow therethrough to allow gas to pass and in so doing provide more resistance to the liquid trying to progress in the same direction toward said inlet.

2. A device for minimizing liquid flow into at least one inlet to a production sting in a gas well, comprising:

at least one flow path on the string extending from the inlet;

at least one material in said path through which all gas or liquid flows in the same direction to reach said inlet that offers greater resistance to flow toward said inlet to liquids than gasses by creating more turbulence to liquid flow than gas flow therethrough to allow gas to pass and in so doing provide more resistance to the liquid trying to progress in the same direction toward said inlet;

said at least one flow path and at least one material comprise a plurality of axially spaced flowpaths each comprising said material that are disposed adjacent a plurality of axially spaced inlets in the production string, whereupon production of liquid at one of said flowpaths redirects gas to other axially spaced flow paths.

3. The device of claim 2, wherein:

said flow path extends on the outside of said string.

4. The device of claim 2, wherein:

said flow path extends on the inside of said string.

5. The device of claim 2, wherein:

said material is porous.

6. The device of claim 5, wherein:

said material comprises connected shapes.

7. The device of claim 2, wherein:

said material comprises sintered stainless steel balls.

8. The device of claim 2, wherein:

said flow path comprises a shroud through which the gas flows to said inlet that spans over said opening.

9. The device of claim 8, wherein:

said flowpath comprises a screen that extends into said shroud.

10. The device of claim 9, wherein:

said screen is sealed at opposed ends.

11. The device of claim 10, wherein:

said screen and said material extend beyond said shroud and are sealed at opposed ends.

12. The device of claim 9, wherein:

said screen is a wire wrap screen.

13. A method of controlling liquid production into a production tubing in a gas well extending from a surface, comprising:

delivering a production string comprising a plurality of inlets to a desired location downhole;

providing a flow path to the inlets that provides greater resistance to flow to liquids than gasses;

creating more turbulence for liquid flow than gas flow in a porous material in the flow path;

producing fewer liquids at said inlets due to the configuration of said flow path and transporting flow from said inlets to the surface using the pressure at the downhole location.

14. The method of claim 13, comprising:

providing a shroud over said porous material that spans an inlet.

15. The method of claim 14, comprising:

providing a screen over said porous material.

16. The method of claim 15, comprising:

sealing opposed ends of said screen and porous material.

17. The method of claim 16, comprising:

extending said screen and porous material beyond said shroud.

18. The method of claim 17, comprising:

forming said porous material from at least one of conjoined spheres or other shapes, porous sintered stainless balls, resin coated gravel pack sand, a woven mesh material, or gravel pack sand.

19. The method of claim 13, comprising:

redirecting gas flow to other inlets than those where liquids are being produced.

* * * * *